US009375651B2

(12) United States Patent
Wong

(10) Patent No.: US 9,375,651 B2
(45) Date of Patent: Jun. 28, 2016

(54) TOY GLOVE INCLUDING FLUID RETAINING PORTION

(71) Applicant: Easebon Services Limited, Kwun Tong (HK)

(72) Inventor: Veronica Pui Chung Wong, Jardine's Lookout (HK)

(73) Assignee: Easebon Services Limited, Kwun Tong (HK)

( * ) Notice: Subject to any disclaimer, the term of this patent is extended or adjusted under 35 U.S.C. 154(b) by 52 days.

(21) Appl. No.: 14/087,833

(22) Filed: Nov. 22, 2013

(65) Prior Publication Data

US 2015/0147931 A1 May 28, 2015

(51) Int. Cl.
*A63H 33/00* (2006.01)

(52) U.S. Cl.
CPC ..... *A63H 33/00* (2013.01); *A63H 33/009* (2013.01)

(58) Field of Classification Search
CPC ..... A63H 33/00
USPC ..... 446/26
See application file for complete search history.

(56) References Cited

U.S. PATENT DOCUMENTS

| | | | | | |
|---|---|---|---|---|---|
| 304,556 | A * | 9/1884 | Petersen | 2/159 | |
| 836,181 | A * | 11/1906 | Gray | 239/529 | |
| 1,534,208 | A * | 4/1925 | Gibson | 239/288 | |
| 1,558,930 | A * | 10/1925 | Schuck | 239/529 | |
| 2,562,418 | A * | 7/1951 | Enrico et al. | 601/155 | |
| 2,817,088 | A * | 12/1957 | Vrana | 2/18 | |
| 2,881,445 | A * | 4/1959 | Vrana | 2/18 | |
| 3,802,009 | A * | 4/1974 | Clemente | A63B 31/04 273/458 | |
| 3,824,992 | A * | 7/1974 | Nicholson et al. | 601/152 | |
| 3,868,952 | A * | 3/1975 | Hatton | 602/13 | |
| 3,937,215 | A * | 2/1976 | Barthlome | 601/40 | |
| 4,037,790 | A * | 7/1977 | Reiser et al. | 239/529 | |
| 4,173,218 | A * | 11/1979 | Cronin | 602/21 | |
| 4,281,647 | A * | 8/1981 | Antypas | 602/21 | |
| 4,655,722 | A * | 4/1987 | Baron et al. | 446/226 | |
| 4,745,649 | A * | 5/1988 | Wang | 5/654 | |
| 4,770,412 | A * | 9/1988 | Wolfe | 482/85 | |
| 4,903,864 | A * | 2/1990 | Sirhan | 222/78 | |
| 5,027,439 | A * | 7/1991 | Spector | 2/20 | |
| 5,123,119 | A * | 6/1992 | Dube | 2/168 | |
| 5,158,208 | A * | 10/1992 | Wilson | 222/78 | |
| 5,169,251 | A * | 12/1992 | Davis | 401/7 | |
| 5,326,515 | A * | 7/1994 | Sakaki et al. | 264/137 | |
| 5,369,807 | A * | 12/1994 | Cho et al. | 2/159 | |
| 5,950,628 | A * | 9/1999 | Dunfee | 128/874 | |
| 6,308,331 | B1 * | 10/2001 | Robak | 2/19 | |
| 6,513,998 | B1 * | 2/2003 | Barry | 401/7 | |
| 6,694,523 | B2 * | 2/2004 | Hurst | 2/161.7 | |
| 7,895,768 | B2 * | 3/2011 | Vossoughi | A47L 13/18 132/200 | |

(Continued)

*Primary Examiner* — Michael Dennis
*Assistant Examiner* — Dolores Collins
(74) *Attorney, Agent, or Firm* — Amster, Rothstein & Ebenstein, LLP

(57) ABSTRACT

A toy glove is disclosed, and includes an inflatable user engagement portion and a fluid retention portion. The fluid retention portion is affixed to the user engagement portion and includes an attachment layer, an absorbent layer, and a retention layer. The absorbent layer is configured to absorb and retain fluid, and is compressible under an applied force so that fluid stored in the absorbent layer is displaced therefrom under pressure. The retention layer covers the absorbent layer and is semi-permeable so that the retention layer inhibits fluid at an equilibrium state from flowing therethrough and allows at least a portion of the fluid displaced from the absorbent layer under pressure to pass therethrough.

20 Claims, 11 Drawing Sheets

(56) References Cited

U.S. PATENT DOCUMENTS

| | | | | |
|---|---|---|---|---|
| 8,158,689 | B2 * | 4/2012 | Baker et al. | 521/50 |
| 8,167,177 | B1 * | 5/2012 | Galgano | 222/175 |
| 8,826,467 | B2 * | 9/2014 | Chew | A47K 7/03 2/160 |
| 2005/0050609 | A1 * | 3/2005 | Villarreal | 2/161.7 |
| 2005/0177965 | A1 * | 8/2005 | Edoh | 15/160 |
| 2007/0136926 | A1 * | 6/2007 | Johnson | B29C 41/14 2/159 |
| 2009/0156309 | A1 * | 6/2009 | Weston et al. | 463/39 |
| 2012/0160257 | A1 * | 6/2012 | Jenkins | 132/200 |
| 2013/0000360 | A1 * | 1/2013 | Ashworth et al. | 66/174 |
| 2014/0373250 | A1 * | 12/2014 | Neault | A41D 19/01594 2/158 |

* cited by examiner

TOY GLOVE INCLUDING FLUID RETAINING PORTION

FIELD

The present invention is directed to a toy glove, and in particular, to a toy glove including a fluid retaining portion.

BACKGROUND

Toy accessories that may be disposed on a portion of a user's body or otherwise wearable, such as toy gloves, may be configured to provide a recreational activity while minimizing or eliminating a risk of injury or damage to a user, other persons, and/or property. In this manner, toy gloves may incorporate a safety feature, such as one or more softened and/or padded portions, to dampen a force of impact of the toy glove with, for example, persons or property.

The incorporation of such safety features to toy gloves, while providing a safer environment within which a user can participate, may change the sensations often associated with impact or contact of solid objects, such as recoil and noise. Additionally or alternatively, users such as youths are prone to seeking activities that provide an abundance of tactile, auditory, and/or visual stimuli.

In an exemplary embodiment of the present disclosure, a toy glove is disclosed. The toy glove allows children to engage in play which may include fantasy or historical battle reenactments, faux combat such as play or pretend boxing, and/or boxing or sparring training, to name a few, without risking physical injury. Because the glove is light and cushioned with air, a user such as a child wearing the glove can land punches on another person such as a playmate without injuring the playmate. The glove itself increases the realism of pretend boxing by having the appearance of a real boxing glove and allowing a wearer to punch a playmate safely. The glove additionally has a layer of padding affixed to its front side. The padding provides additional cushioning, which further enhances the safety of punching with the glove. The padding is also capable of absorbing and retaining a fluid such as liquid. As a result, the glove can be used during play in a pool or other aquatic environment. When near a body of fluid, such as water in a swimming pool, the padding can be saturated with fluid. When a wearer subsequently punches a playmate with the glove, fluid is expelled from the padding, providing an entertaining visual indication of an impact. The expulsion of fluid thus produced also mimics the splashing of sweat from a boxing opponent's face, an effect saliently depicted in films such as Rocky.

An alternative embodiment of the inflatable glove of the present invention can also be fitted with an elongated projection extending forward from the front face. The projection allows the glove to be used as a toy sword. A child wearing the glove can strike a playmate from a greater distance with motions other than punching. The projection therefore enhances the glove's play value by allowing a child to have greater choice in how to use the glove. The projection is covered with padding, which is capable of absorbing a fluid. Upon impact with a playmate, liquid is expelled from the padding, providing an entertaining visual indication of a successful impact.

Accordingly, it would be desirable to provide a toy glove that includes a safety feature while providing enhanced tactile, auditory, and/or visual stimuli.

SUMMARY

In an exemplary embodiment of the present invention, a toy glove comprises an inflatable user engagement portion and a fluid retention portion. The fluid retention portion is affixed to the user engagement portion and comprises an attachment layer, an absorbent layer, and a retention layer. The absorbent layer is configured to absorb and retain fluid, and is compressible under an applied force so that fluid stored in the absorbent layer is displaced therefrom under pressure. The retention layer covers the absorbent layer and is semi-permeable so that the retention layer inhibits fluid at an equilibrium state from flowing therethrough and allows at least a portion of the fluid displaced from the absorbent layer under pressure to pass therethrough.

In an exemplary embodiment of the present invention, the absorbent layer is encased between the attachment layer and the retention layer.

In an exemplary embodiment of the present invention, the retention layer is formed of lycra.

In an exemplary embodiment of the present invention, the attachment layer is configured to be heat sealed to a front end of the user engagement portion.

In an exemplary embodiment of the present invention, the retention layer is stitched to the attachment layer.

In an exemplary embodiment of the present invention, upon impact with the target, the absorbent layer is configured to displace the fluid under pressure in the direction of impact with the target in the form of a splash, stream, wave, or droplets of the fluid.

In an exemplary embodiment of the present invention, the retention layer is reconfigurable between a first, unstressed condition, and a second, deformed condition.

In an exemplary embodiment of the present invention, the retention layer defines a first permeability to fluid in the first condition, and the retention layer defines a second, higher permeability to fluid in the second condition.

In an exemplary embodiment of the present invention, the retention layer has a resilient configuration that tends to return toward the first condition.

In an exemplary embodiment of the present invention, a toy glove comprises an inflatable user engagement portion and a fluid retention portion. The inflatable user engagement portion includes a cavity for receiving a portion of a user's body and a forward extent extending from a front face thereof. The fluid retention portion is attached to the user engagement portion and has an elongate, conical profile. The fluid retention portion comprises an attachment layer, an absorbent layer, and a retention layer. The attachment layer is sealably attached to the user engagement portion. The absorbent layer is configured to absorb and retain fluid, and is compressible under an applied force to displace fluid retained therein. The retention layer is disposed about the absorbent layer and attached to the attachment layer so that the absorbent layer is encased therebetween, the retention layer being semi-permeable so that the retention layer inhibits fluid at an equilibrium state from flowing therethrough and allows at least a portion of the fluid displaced from the absorbent layer under pressure to pass therethrough.

In an exemplary embodiment of the present invention, the retention layer is formed of lycra.

In an exemplary embodiment of the present invention, the visual amplification of impact has the form of a splash, stream, wave, or droplets of the fluid.

In an exemplary embodiment of the present invention, the visual amplification of impact occurs along a direction of impact with the target.

In an exemplary embodiment of the present invention, one or more of the attachment layer, absorbent layer, and retention layer has a different length.

In an exemplary embodiment of the present invention, the forward extent has a conical configuration.

In an exemplary embodiment of the present invention, the retention layer is reconfigurable between a first, unstressed condition, and a second, deformed condition.

In an exemplary embodiment of the present invention, the retention layer defines a first permeability to fluid in the first condition, and the retention layer defines a second, higher permeability to fluid in the second condition.

In an exemplary embodiment of the present invention, the retention layer has a resilient configuration that tends to return toward the first condition.

In an exemplary embodiment of the present invention, a method of using a toy glove comprises providing a toy glove comprising a user engagement portion a fluid retention portion affixed to the user engagement portion. The fluid retention portion comprises an attachment layer, an absorbent layer, and a retention layer. The absorbent layer is configured to absorb and retain fluid, and is compressible under an applied force. The retention layer covers the absorbent layer and is semi-permeable. The method further comprises exposing the user engagement portion to a fluid. The method further comprises exerting a force on the user engagement portion so that the absorbent layer is compressed to cause a pressure differential to draw fluid through the retention layer. The method further comprises impacting the user engagement portion against a target so that an impact force is exerted on the absorbent layer to cause displacement of fluid through the retention layer in the direction of impact.

In an exemplary embodiment of the present invention, the step of impacting the user engagement portion against a target includes reconfiguring the retention layer from a first, unstressed condition to a second, deformed condition having a higher permeability to fluid than the first condition.

BRIEF DESCRIPTION OF THE DRAWINGS

The features and advantages of the present invention will be more fully understood with reference to the following detailed description of illustrative embodiments of the present invention when taken in conjunction with the accompanying figures, wherein.

DETAILED DESCRIPTION OF EMBODIMENTS

Apparatuses according to exemplary embodiments of the present disclosure may include a toy glove having a user engagement portion and a fluid retaining portion. Exemplary embodiments of the present disclosure may be utilized in a variety of activities such as recreation, sport, and/or play, which may include fantasy or historical battle reenactments, faux combat such as play or pretend boxing, and/or boxing or sparring training, to name a few. Embodiments of the present disclosure may be utilized in other suitable activities as contemplated by one skilled in the art of the present disclosure.

Figure 1A:
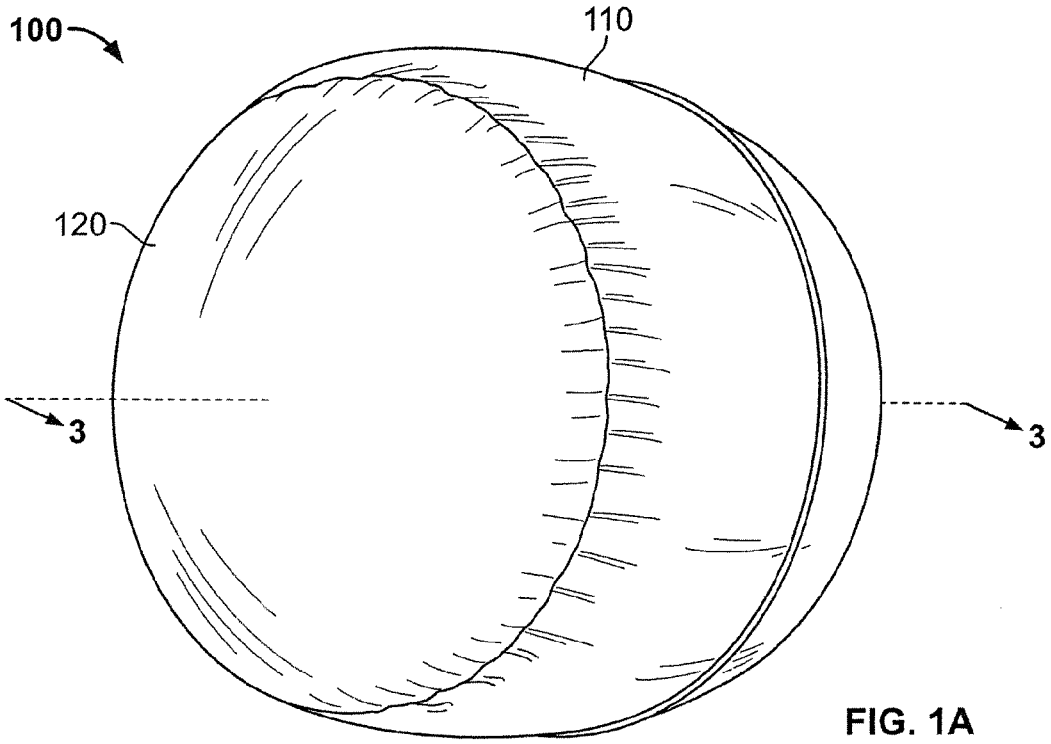
FIG. 1A is a front perspective view of a toy glove according to an exemplary embodiment of the present disclosure.
Figure 1B:
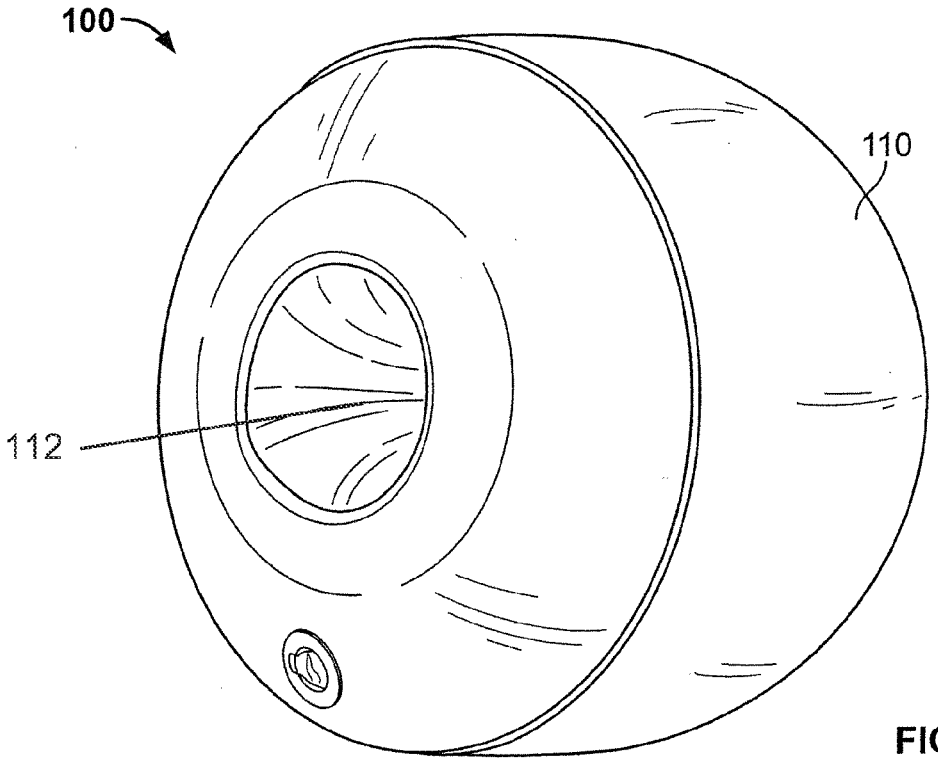
FIG. 1B is a rear perspective view of a toy glove according to an exemplary embodiment of the present disclosure.

Turning to FIGS. 1A and 1B, a toy glove according to an exemplary embodiment of the present disclosure is generally designated as 100. Toy glove 100 may include a user engagement portion 110 and a fluid retention portion 120. Fluid retention portion 120 may be affixed to user engagement portion 110 so that toy glove 100 has a unitary configuration. User engagement portion 110 and fluid retention portion 120 may together form an elongate member having a substantially-circular cross sectional profile, for example, cylindrical or drum-shaped member. In embodiments, toy glove 100 or at least one portion thereof may have a variety of configurations, for example, tubular, spheroid, pyramidal, and/or combinations thereof, to name a few. In embodiments, toy glove 100 may include one or more flat and/or curvate outer surfaces, for example, a concave surface or a convex surface. In embodiments, toy glove 100 may have a symmetric or asymmetric configuration. In embodiments, a fluid retaining portion or otherwise forward-facing portion of toy glove 100 may have a variety of configurations, such as cylindrical, cone-shaped, sword-shaped, disc-shaped, or flat blade-shaped, to name a few.

Figure 2:
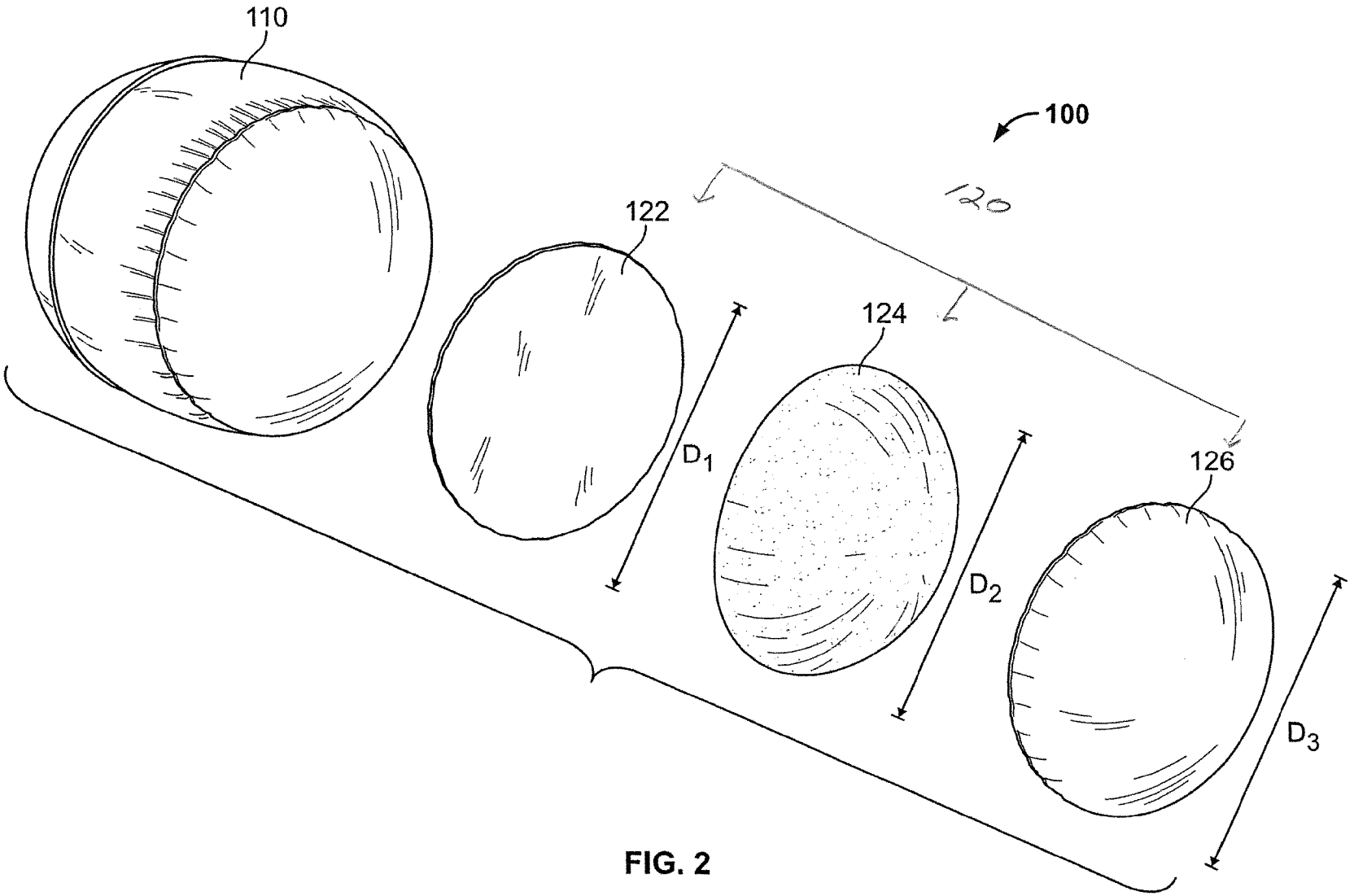
FIG. 2 is an exploded view of the toy glove of FIG. 1A.

With additional reference to FIG. 2, toy glove 100 may have a layered configuration so that toy glove 100 has a variable consistency therealong. Fluid retention portion 120 may include an attachment layer 122, an absorbent layer 124, and a retention layer 126. Each layer 122, 124, 126 may have a similar side and/or cross-sectional profile, such as curvate, so that layers 122, 124, 126 may be brought into contact in a substantially flush, abutting, or superposed relationship. In embodiments, layers 122, 124, and/or 126 may have substantially different side and/or cross-sectional profiles. In embodiments, attachment layer 122, absorbent layer 124, and/or retention layer 126 may be incorporated into one or both of user engagement portion 110 and fluid retention portion 120. In embodiments, toy glove 100 may include greater or fewer layers of materials.

Attachment layer 122 may have a complementary configuration to a front end 110*b* of glove portion 110 so that attachment layer 122 may be configured for coupling with the front end 110*b* of glove portion 110, as will be described further herein. In embodiments, attachment layer 122 may be formed of, for example, a polymeric material such as plastic. In embodiments, attachment layer 122 may be formed of a substantially similar material to user engagement portion 110.

Absorbent layer 124 may be positioned between attachment layer 122 and retention layer 126. Absorbent layer 124 may be configured to be encased between attachment layer 122 and retention layer 126. Accordingly, absorbent layer 124 may have a diameter $D_2$ that may be less than a diameter $D_1$ of attachment layer 122 and a diameter $D_3$ of retention layer 126. Absorbent layer 124 may be configured to absorb and/or retain fluids. In embodiments, absorbent layer 124 may be formed of, for example, open or closed cell foam, a mesh material, or another type of foraminous or otherwise absorbent material, for example, a cotton or polyester fiber material. In such embodiments, absorbent layer 124 may be formed of a material that is compressible and/or resilient so that an external force may be applied to absorbent layer 124, for example, to displace fluids retained therein. In embodiments, absorbent layer 124 may be configured to be deformed from a first, initial condition, to a second, compressed condition and tend to return toward the initial condition. Transitioning of the absorbent layer 124 from the first condition to the second condition may have the effect of displacing fluids disposed therein. In embodiments, transitioning the absorbent layer 124 from the first condition to the second condition may cause fluid such as liquid disposed in the absorbent layer 124 to become compressed and displaced from the absorbent layer 124 under pressure. In embodiments, transitioning the absorbent layer 124 from the first condition to the second condition may cause fluid such as air to be expelled from the absorbent layer 124 so than an at least partial vacuum is formed within absorbent layer 124. In this manner, reconfiguration of the absorbent layer 124 may cause forced displacement of in fluid disposed therein.

Retention layer 126 may be at least semi-permeable to fluid and may be configured to be disposed over absorbent layer 124. Retention layer 126 may be configured to be attached to attachment layer 122 so that absorbent layer 124 is encased therein. In embodiments, retention layer 126 may have a permeability to fluid such that fluid in an equilibrium state surrounding retention layer 126 may be inhibited or prevented from passing therethrough. In embodiments, retention layer 126 may be configured such that fluids under pressure can pass through retention layer 126 at a rate greater than fluids in an equilibrium state with respect to retention layer 126. In this manner, retention layer 126 may be configured so that forced fluids can pass through retention layer 126 while unforced fluids may be inhibited or prevented from passing through retention layer 126.

Additionally or alternatively, retention layer 126 may be reconfigurable between a first, initial condition, and a second, deformed condition by a force applied thereto. In the first condition, retention layer 126 may have a first permeability to fluid so that retention layer 126 is configured to substantially inhibit or prevent the passage of fluid therethrough. In the second condition, an applied force causes retention layer 126 to reconfigure so that retention layer 126 has a second, higher permeability to fluid to permit an increased volume of fluid to pass therethrough as compared to the first porosity in the first condition of retention layer 126.

In embodiments, retention layer 126 may be formed of a resilient material configured to mechanically deform and return to its resting or unstressed condition, for example, a synthetic fiber fabric such as spandex, lycra, elastin, nylon, or stretchable cotton.

Figure 3:
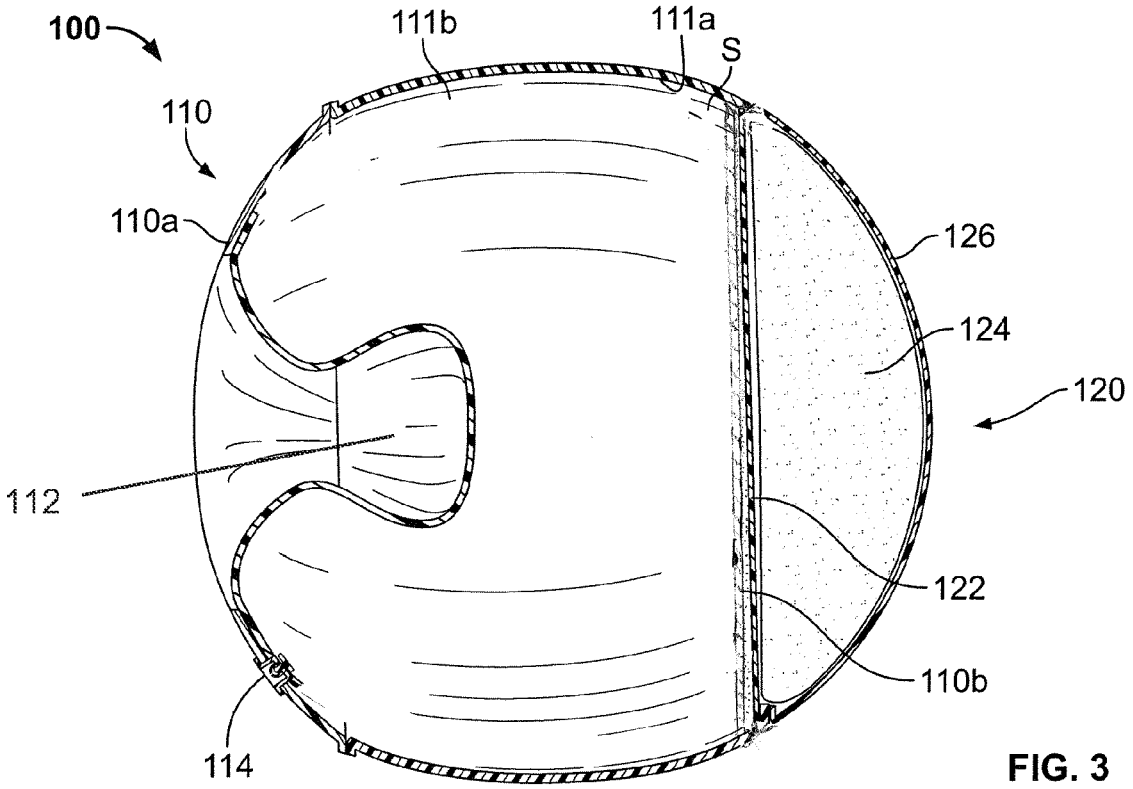
FIG. 3 is a cross-sectional view taken along line 3-3 of FIG. 1A.

Referring additionally to FIG. 3, toy glove 100 is illustrated assembled in cross-sectional view. User engagement portion 110 of toy glove 100 may be configured as a hollow member so that user engagement portion 110 includes an outer wall 111 with a space S formed therein. User engagement portion 110 may be formed of a material suitable to store fluid therein, such as a polymeric material. In this manner, user engagement portion 110 may be configured so that a fluid, such as air, may be stored within the space S inside outer wall 111. In embodiments, user engagement portion 110 may be formed of a flexible material so that user engagement portion 110 is reconfigurable under an applied force. In this manner, user engagement portion 110 may be configured so that fluids may be input or withdrawn from space S to cause a corresponding reconfiguration of user engagement portion 110, such as an inflatable member. In embodiments, user engagement portion 110 may include a fluid port 114 extending through outer wall 111 thereof so that fluids such as gases may enter or exit space S. In embodiments, fluid port 114 may be configured to control the direction and/or quantity of fluids flowing therethrough, such as a one-way or two-way valve. In embodiments, fluid port 114 may include a body suitable for engagement with a source of fluid, such as a pump or a user's airway. Such an inflatable configuration of toy glove 100 provides a safety feature that may inhibit, minimize, and/or prevent a risk of injury and/or damage to the user, other persons, and/or property. In embodiments, toy glove 100 may incorporate different and/or additional safety features, such as padding or other force dampeners.

User engagement portion 110 may include a cavity 112 formed therein. Cavity 112 may be configured as a recess extending from a rear end 110*a* of user engagement portion 110 to a terminus spaced from the front end 110*b* of user engagement portion 110. Cavity 112 may be formed, for example, by molding. In embodiments, cavity 112 may be formed by removing portions of user engagement portion 110 and thereafter sealing user engagement portion 110 to form an enclosed member. In embodiments, cavity 112 may include a surface feature to enhance contact between a portion of a user and cavity 112, such as a sprayed, dipped, or otherwise applied coating of a slip-resistant material such as flocking. In embodiments, cavity 112 may include a layer of soft material to enhance comfort for a user and/or absorb sweat or other fluids. In embodiments, a surface feature may be applied to cavity 112 as part of a liner disposed within cavity 112. A portion of a user's body may be inserted into the cavity 112 so that friction between the surface of the cavity 112 and the portion of the user's body may retain the toy glove 100 thereon. In embodiments, user engagement portion 110 may present a different surface for engagement by a user, for example, a projection such as a handle, a sleeve or strap, or a gripping surface formed on an outer surface of the user engagement portion 110, to name a few.

As shown, fluid retention portion 120 may be affixed to the front end 110*b* of user engagement portion 110*b*. Attachment layer 122 may be configured to be attached to front end 110*b* by for example, heat sealing, ultrasonic welding, or adhesion, to name a few. As described above, retention layer 126 is attached to attachment layer 122 so that absorbent layer 124 is enclosed therein. Retention layer 126 may be attached to attachment layer 122 via a binding member, such as stitching or threading. Because such attachment methods may require the use of a stitching member, such as a needle, fluid retention portion 120 may be assembled prior to the attachment of attachment layer 122 to the front end 110*b* of user engagement portion 110 to eliminate the risk of a stitching member puncturing user engagement portion 110. In embodiments, fluid retention portion 120 may be assembled and/or attached to user engagement portion in another manner. In embodiments, absorbent layer 124 may be affixed directly to the front end 110*b* of user engagement portion 110, for example, by adhesion. In embodiments, retention layer 126 may be extended over absorbent layer 124 to be directly attached to user engagement portion 110, for example, by adhesion. In embodiments, layers 122, 124, 126 may be assembled in any other suitable manner and/or may have different relative geometries and/or profiles.

Figure 4A:
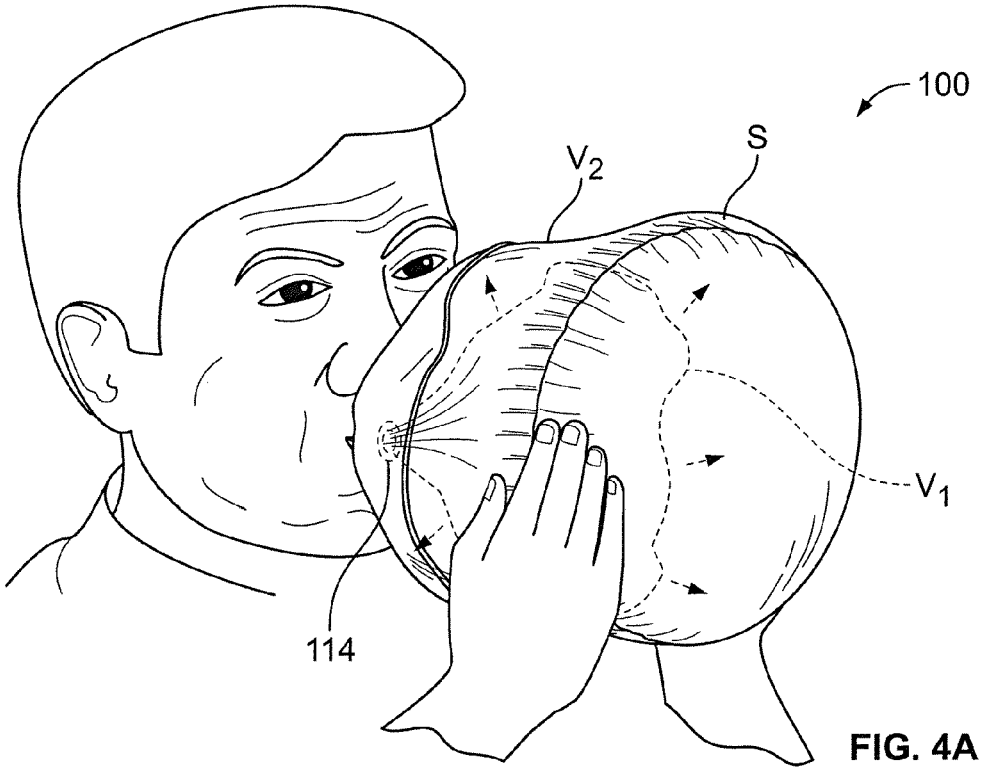
FIG. 4A is a first sequential view of a method of using the toy glove of FIG. 1A according to an exemplary embodiment of the present disclosure.

Turning now to FIG. 4A, toy glove 100 may be provided in a first, non-inflated condition. A user may access fluid port 114, for example, by placing a portion of fluid port 114 in his or her mouth or by coupling fluid port 114 with a source of fluid, such as a pump or hose. Fluid such as air or another type of gas may then be input through fluid port 114 into the space S within the user engagement portion 110 such that the user engagement portion 110 expands to a second, inflated condition. The second, inflated condition of toy glove 100 may have a volume $V_2$ that is larger than a volume $V_1$ of toy glove in the first, uninflated condition.

Figure 4B:
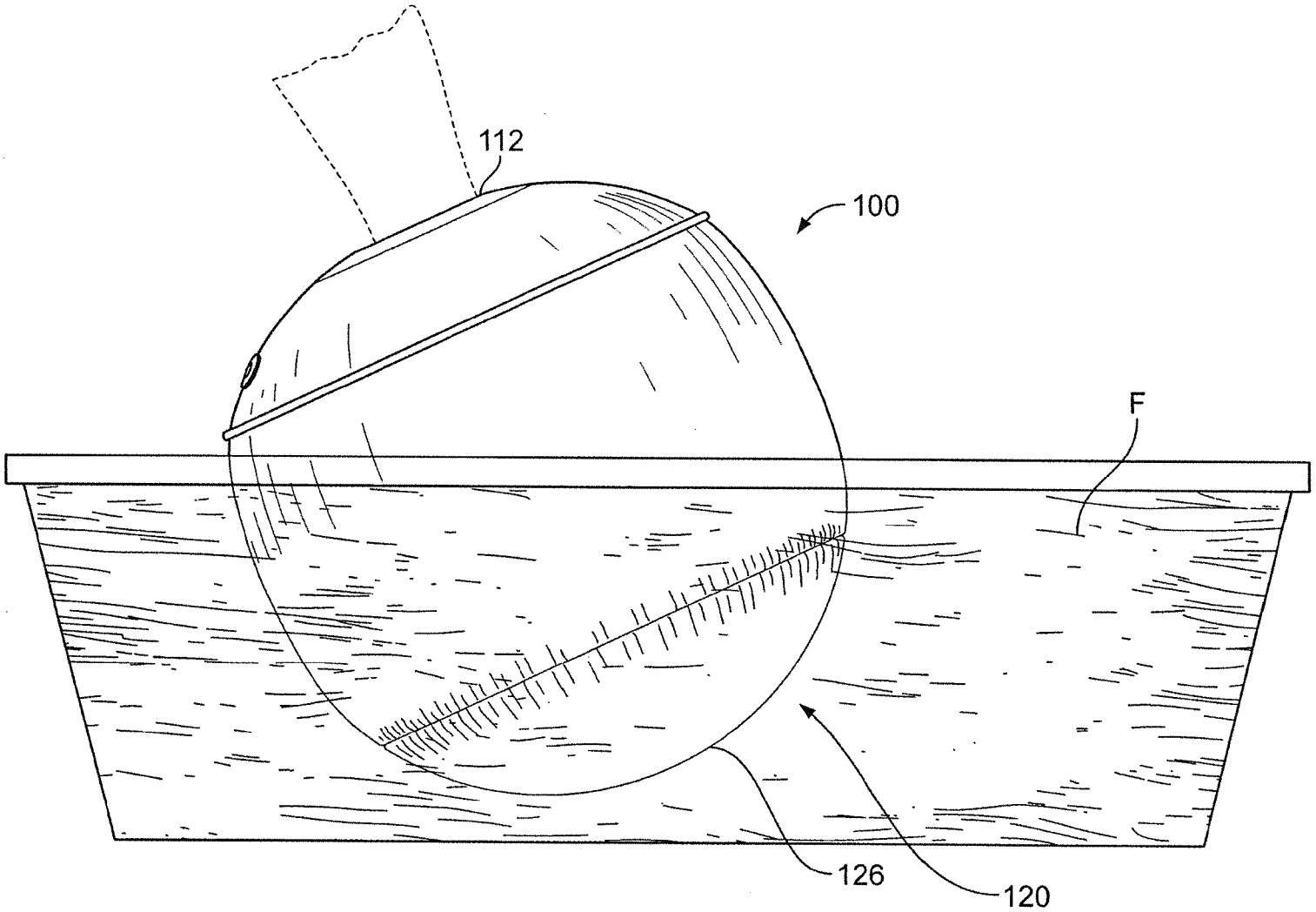
FIG. 4B is a second sequential view of a method of using the toy glove of FIG. 1A according to an exemplary embodiment of the present disclosure.

Turning to FIG. 4B, a user may insert a portion of his or her body, for example, a hand, wrist, and/or forearm, into cavity 112 so that toy glove 100 is coupled with a portion of the user's body. Cavity 112 may be reconfigurable, such as through dilation or contraction, to accommodate passage of objects of various sizes so that cavity 112 may dilate in the presence of an object being passed therethrough. In embodiments, cavity 112 may have resilient properties, for example, cavity 112 may tend to contract toward its resting condition so that toy glove 100 has a snug or at least partially compressed fit about a portion of the user's body, such as a user's hand, wrist, and/or forearm.

As shown in FIG. 4B, a user may bring at least the fluid retention portion 120 of toy glove 100 into contact with a fluid F, for example, water. In embodiments, the user may at least partially submerge toy glove 100 into a container of fluid F. In embodiments, fluid F may be stored in any container, such as a sink, swimming pool, or natural boundary. In embodiments, the fluid retention portion 120 may be brought into contact with fluid F by another method, such as by spraying or otherwise dispensing fluid F onto or into the fluid retention portion 120.

Fluid retention portion 120 may be arranged so that the absorbent layer 124 is substantially isolated from fluid by the retention layer 126 when the absorbent layer 124 is in a first, initial condition.

Figure 4C:
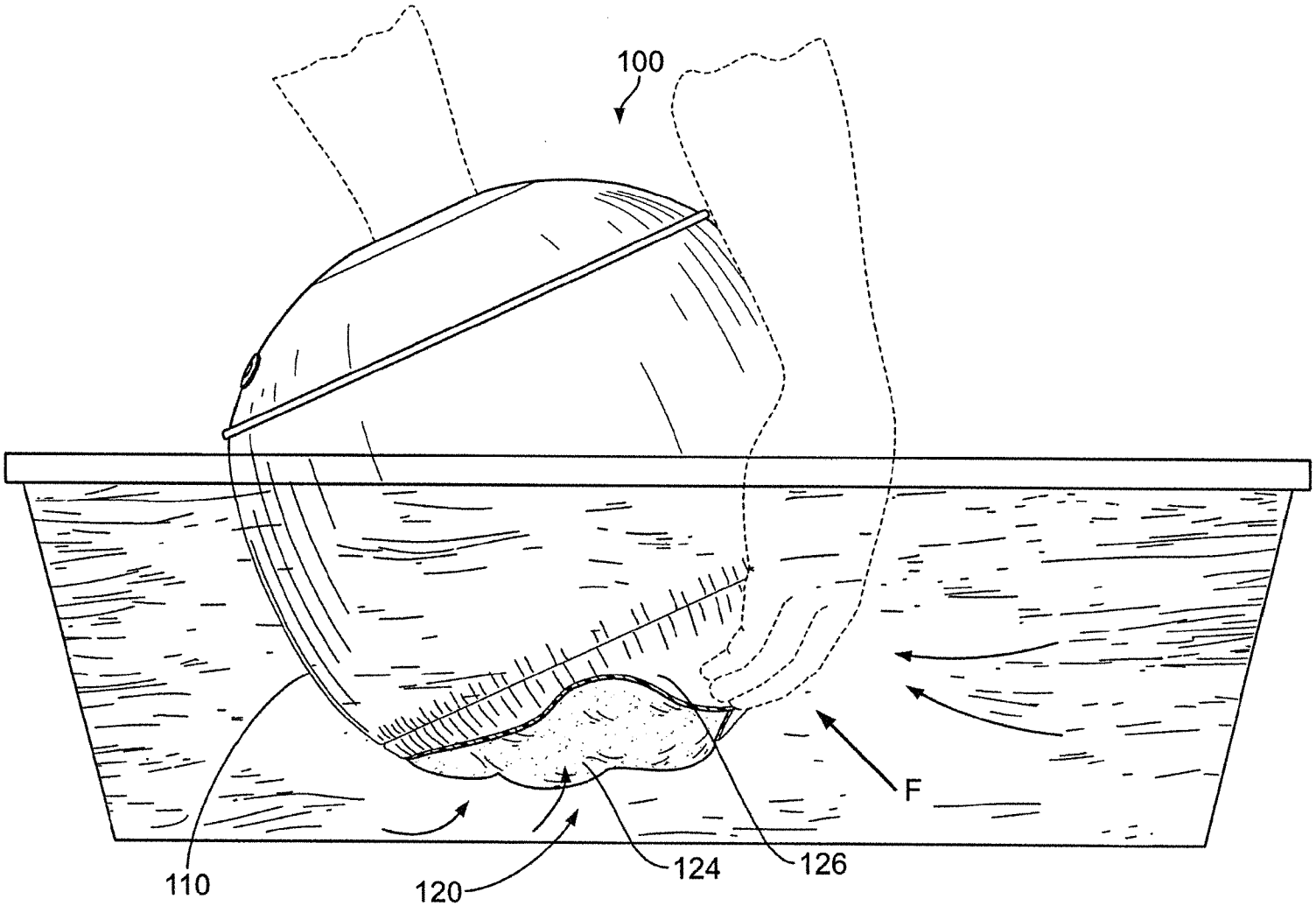
FIG. 4C is a third sequential view of a method of using the toy glove of FIG. 1A according to an exemplary embodiment of the present disclosure.

Referring to FIG. 4C, a user may apply a force to the fluid retention portion 120 so that the absorbent layer 124 reconfigures from the first condition to the second condition so that an increased amount of fluid F can pass through the retention layer 126. A user may reconfigure the absorbent layer 124 through mechanical deformation via an applied force, such as by crushing, bending, warping, pressing, stretching, twisting, wringing, or otherwise applying an external force to absorbent layer 126. Such a reconfiguration of the absorbent layer 124 may cause the evacuation of fluid such as air from within the absorbent layer 124 resulting in an at least partial vacuum. This at least partial vacuum creates a pressure differential about the retention layer 126 such that fluid F is drawn therethrough into absorbent layer 124. As described above, absorbent layer 126 may have resilient properties, for example, so that the absorbent layer 124 tends to return to the first condition when an external force is removed.

As shown, a user may press against or otherwise force the retention layer 126 with a portion of his or her body, for example, a hand. In embodiments, the absorbent layer 124 and the adjacent retention layer 126 may be compressed between the portion of the user's body upon which toy glove 100 is disposed, and another portion of the user's body, such as the user's opposite hand. As the retention layer 126 is reconfigured to the second condition, fluid F passes therethrough and is absorbed by the absorbent layer 124. Absorption of the fluid F by the absorbent layer 124 may cause the absorbent layer to swell, for example increase in volume and/or density as fluid F is retained.

Additionally or alternatively, the force applied to the fluid retention portion 120 may cause the retention layer 126 to reconfigure from a first condition to a second, higher porosity condition so that an increased amount of fluid F can pass therethrough.

Figure 4D:
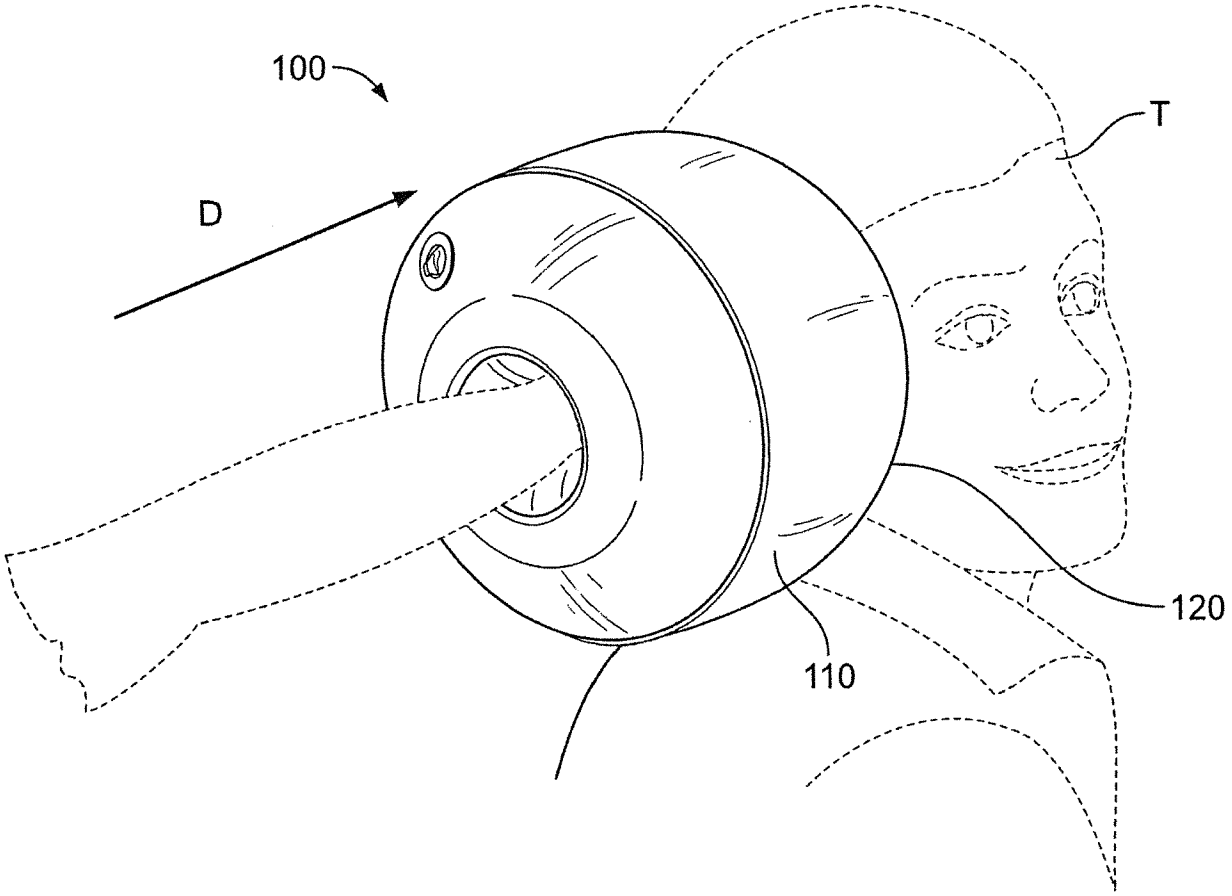
FIG. 4D is a fourth sequential view of a method of using the toy glove of FIG. 1A according to an exemplary embodiment of the present disclosure.

Turning to FIG. 4D, a user may withdraw the toy glove 100 from the container or source of fluid F. As the retention layer 126 is normally in the first condition, fluid F is substantially retained within the user engagement portion 120 of toy glove 100 during movement of the toy glove 100. Alternatively, the permeability of the retention layer 126 is such as to retain the fluid F in the absorbent layer 124 when the fluid F is not under pressure. A user may then engage in activities with the toy glove 100 such as recreation, play, and/or sport. In embodiments, the user may engage in faux combat, such as battle reenactments or non-injurious boxing, using toy glove 100. Toy glove 100 may be used in such a manner due to the soft nature of glove portion 110 and/or fluid retention portion 120 without substantial risk of injury to his or herself, other persons, and/or property. As shown, a user may move toy glove 100 toward a target T by extending, punching, swinging, or slapping toy glove 100. In embodiments, target T may be an intended impact surface on, for example, another person or object. In embodiments, target T may be an unintended impact surface. In embodiments, target T may be designated by a marking or other indicium.

Figure 4E:
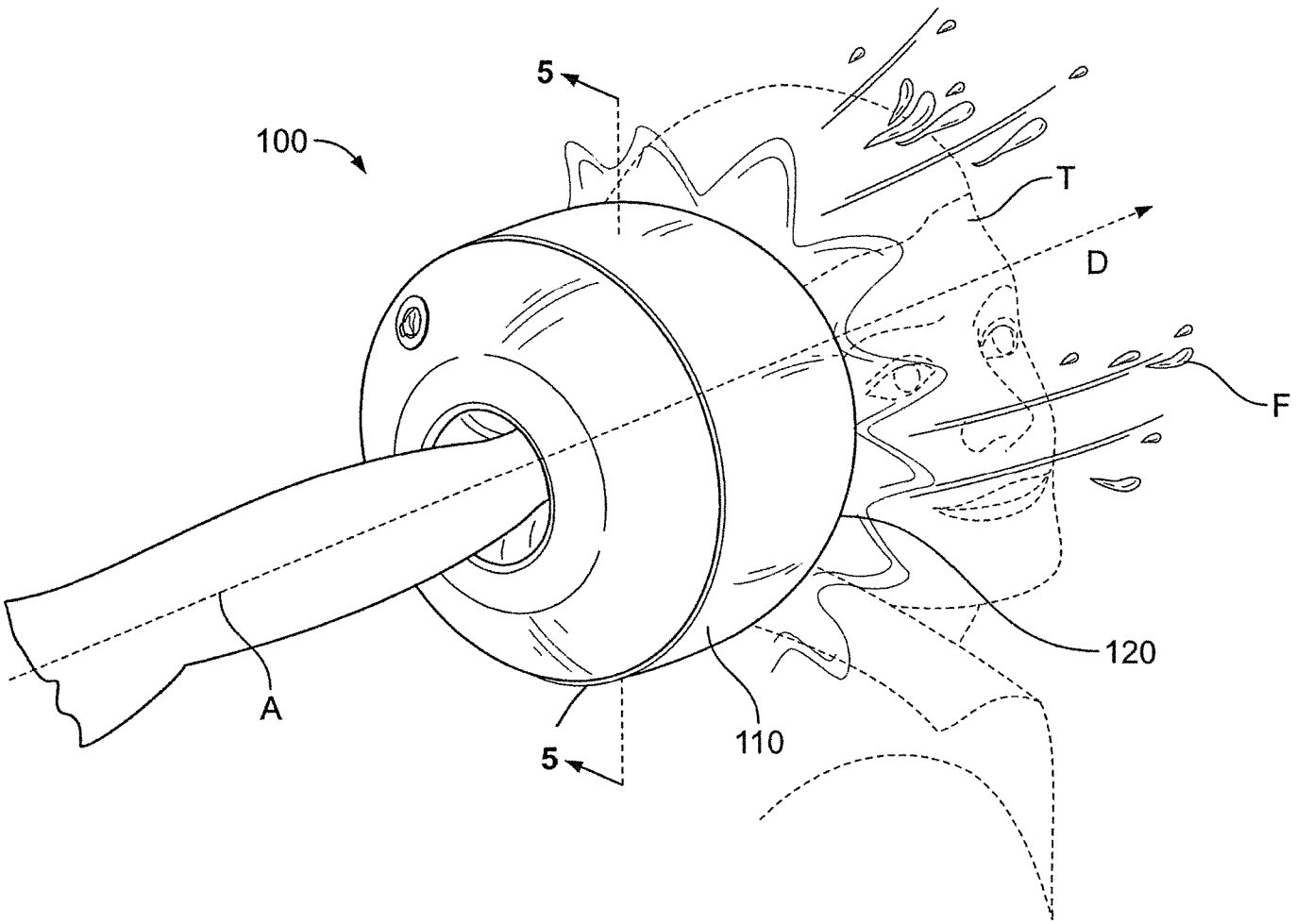
FIG. 4E is a fifth sequential view of a method of using the toy glove of FIG. 1A according to an exemplary embodiment of the present disclosure.
Figure 5:
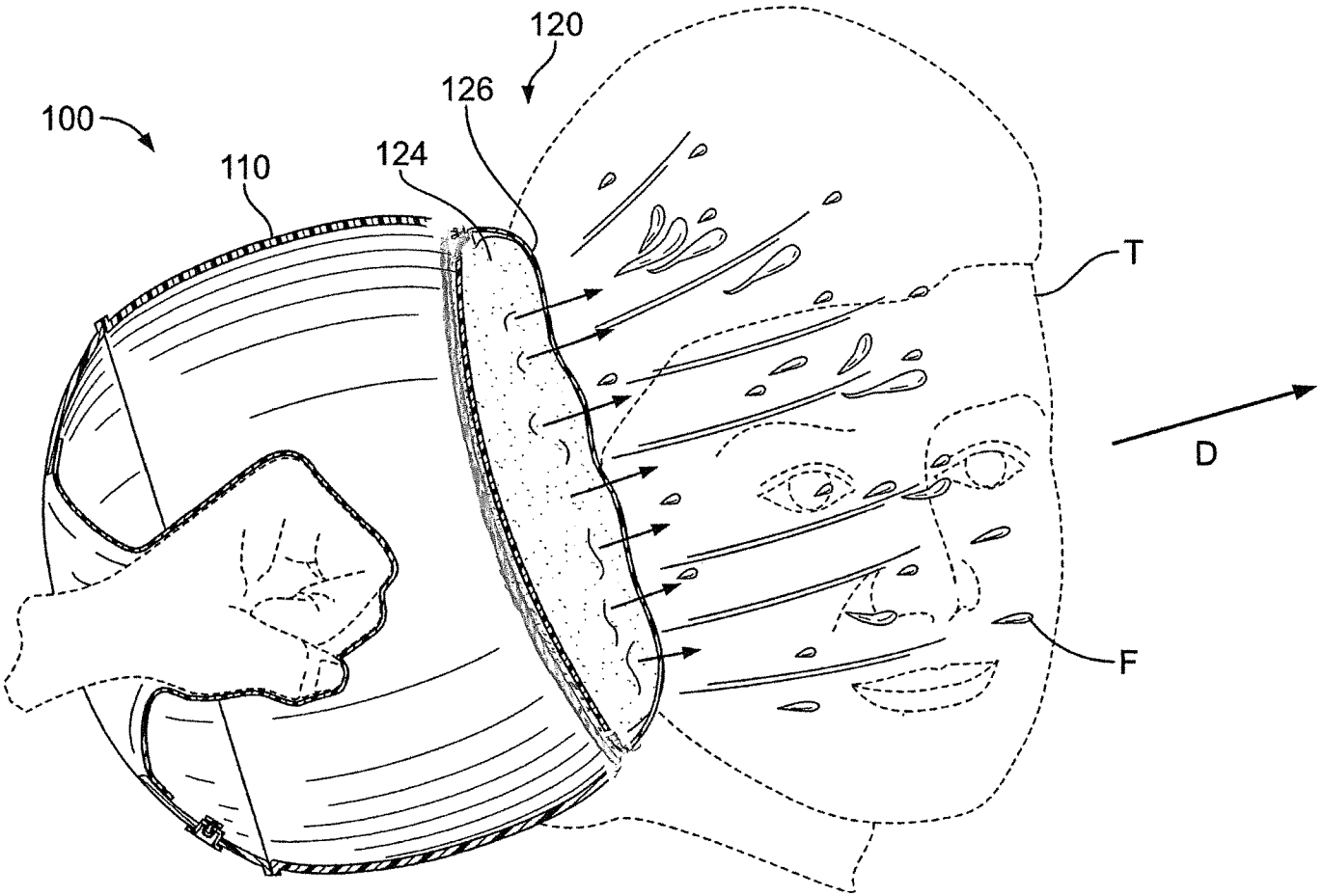
FIG. 5 is a cross-sectional view taken along line 5-5 of FIG. 4E.

Referring to FIGS. 4E and 5, as toy glove 100 impacts target T, an impact force is transferred to toy glove 100. In particular, toy glove 100 may be configured so that user engagement portion 120 receives at least a portion of an impact force with target T. User engagement portion 120 may directly receive an impact force, or an impact force may be transferred to user engagement portion 120 through an intermediate portion of toy glove 100, such as in a glancing impact with target T.

As the user engagement portion 120 receives the impact force, the absorbent layer 124 may be at least partially compressed between, for example, the user's hand and the target T. The force of impact may cause the absorbent layer 124 to reconfigure from the first condition to the second condition so that the fluid F disposed in the absorbent layer 124 is displaced therefrom under pressure to pass through the retention layer 126 in a direction D of impact. Simultaneously, the impact force causes an at least partial compression of the absorbent layer 124 in the user engagement portion 120 so that fluid F is displaced from absorbent layer 124 and through the retention layer 126 in a direction D of impact. Additionally or alternatively, the force of impact of the toy glove 100 with the target T may cause the retention layer 126 to reconfigure from a first, unstressed condition to a second, deformed condition having a higher permeability to fluid so that an increased amount of fluid F can pass therethrough.

In embodiments, the force of impact of toy glove 100 with target T imparts motion to free fluid F stored in absorbent layer 124 therefrom, in addition to fluid F displaced under pressure. Thus, at least a portion of fluid F may travel in the direction D of impact under an inertial force such that this portion of fluid F can pass through the retention layer 126 and toward target T.

In either manner, fluid F travels substantially along the direction D of impact so that a visual, tactile, and/or auditory amplification of the impact is provided. In embodiments, the amplification of impact may have the form of a splash, stream, wave, and/or droplets of fluid F.

Figure 6:
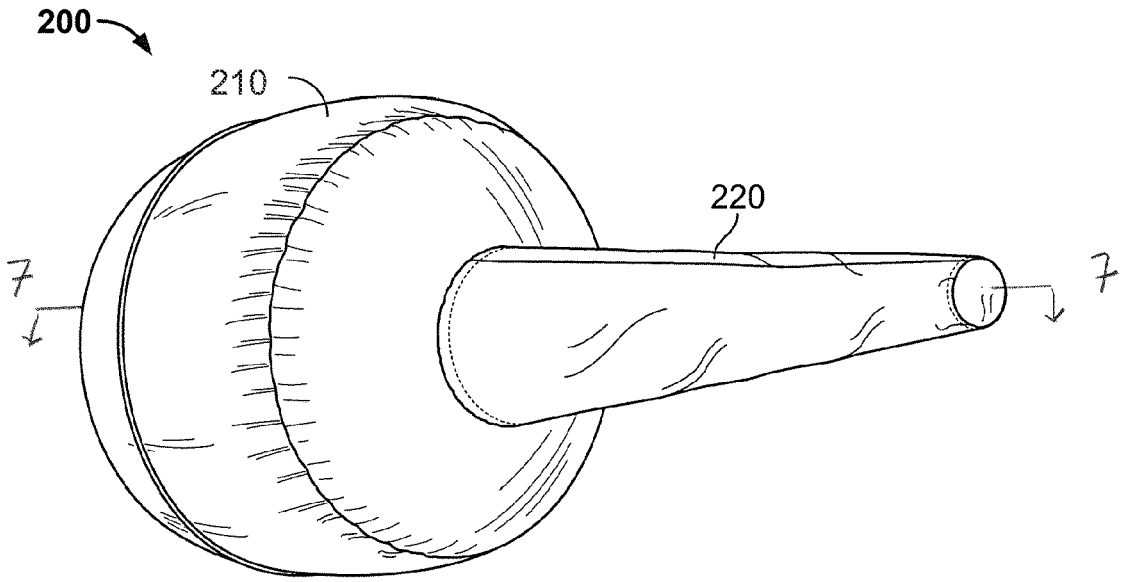
FIG. 6 is a perspective view of a toy glove according to an exemplary embodiment of the present disclosure.

Turning to FIG. 6, an exemplary embodiment of a toy glove is generally designated 200. Toy glove 200 may include a user engagement portion 210 that may include similar features to user engagement portion 110 described above, such as a cavity 112 for inflation defined therein. However, a front portion of user engagement portion 210 of toy glove 200 may define a forward extent 211 extending away from a user. Forward extent 211 may have a conical configuration so that toy glove 200 has a fluid retention portion 220 with a generally elongate, conical configuration. In embodiments, fluid retention portion 220 may have a different configuration with an elongate, tapered profile so that fluid retention portion 220 has the form of, for example, a sword, club, bat, or joust, to name a few. Forward extent 211 may have a hollow interior in fluid communication with cavity 110 for inflation thereof. In embodiments, forward extent 211 may define a cavity for inflation that is isolated from the cavity 112. In embodiments, forward extent 211 may be a separate member attached to the remainder of user engagement portion 210.

Figure 7:
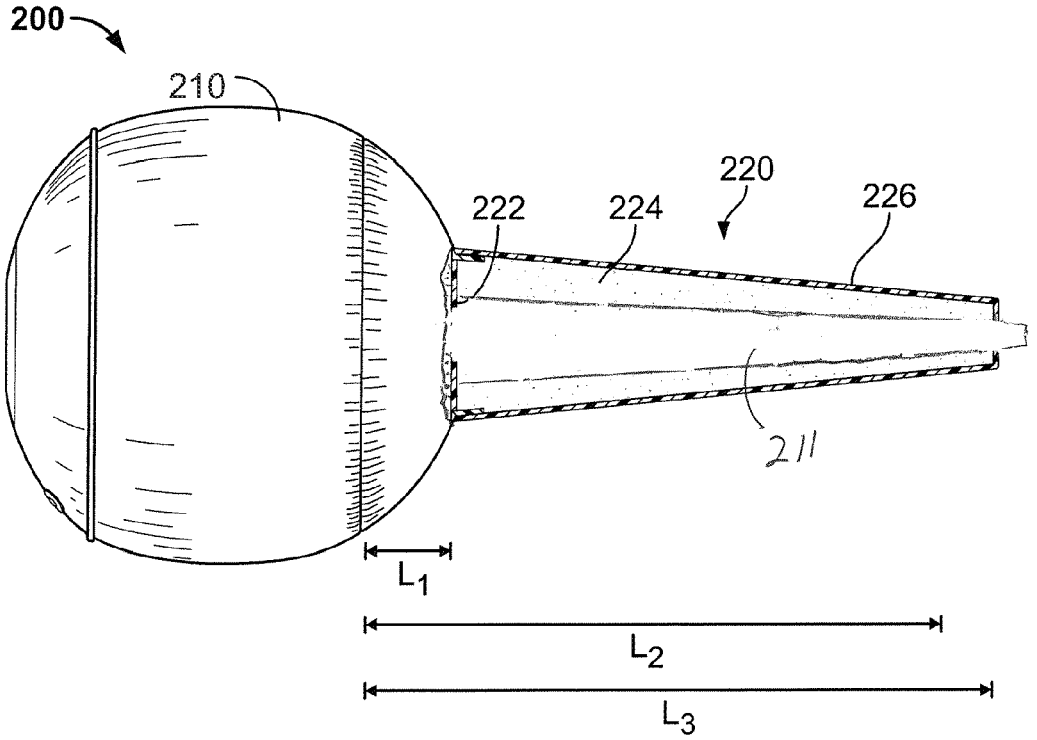
FIG. 7 is a partial cross-sectional view taken along line 7-7 of FIG. 6.

Referring to FIG. 7, toy glove 200 is shown in cross-sectional view. Fluid retention portion 220 may include an attachment layer 222, an absorbent layer 224, and a retention layer 226. Layers 222, 224, 226 may be formed of substantially similar materials and/or have substantially similar properties as respective layers 122, 124, 126 described above.

Absorbent layer 224 may be configured to overlie the forward extent 211 of user engagement portion 210. Absorbent layer 224 may have a complementary, conical configuration to forward extent 211 so that absorbent layer 224 can at least partially overlie forward extent 211. Absorbent layer 224 may be a length of material that is at least partially wrapped or folded about forward extent 211, and may define an open end through which a tip of the forward extent 211 is exposed. In embodiments, absorbent layer 224 may overlie the tip of the forward extent 211. In embodiments, absorbent layer 224 may be adhered or otherwise attached to forward extent 211.

Retention layer 226 may be disposed over absorbent layer 224 such that absorbent layer 224 may be in an enclosed pocket of toy glove 200. In embodiments, retention layer 226 may be adhered to one or both of forward extent 211 or absorbent layer 224.

In embodiments, attachment layer 222 may be stitched or bound to retention layer 226 with attachment layer 224 heat sealed to user engagement portion 210 so that absorbent layer 224 is disposed in an enclosed pocket therebetween in the manner described above with respect to toy glove 100. In embodiments, attachment layer 222 may overlay the entire forward extent 211 so that user engagement portion 210 and absorbent layer 224 are each attached thereto. In embodiments, attachment layer 222 may overlay a portion of forward extent 211, such as an annular portion of forward extent 211, so that attachment layer 222 is coupled to user engagement portion 210 along a portion thereof.

Figure 8A:
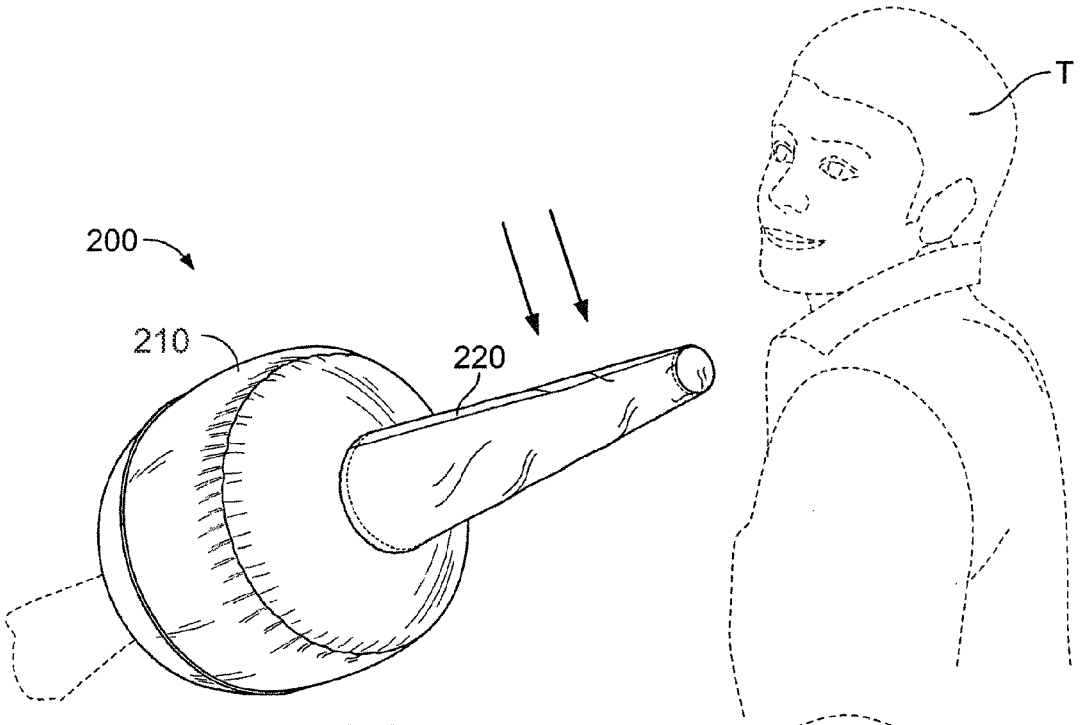
FIG. 8A is a first sequential view of a method of using the toy glove of FIG. 6.

Turning to FIG. 8A, engagement portion 220 may be exposed to a fluid F and absorbent layer 224 deformed in the manner described above with respect to toy glove 100 so that an at least partial vacuum is created therein to draw fluid F through retention layer 226. Additionally or alternatively, retention layer 226 may be subject to an applied force so that retention layer 226 reconfigures between a first, unstressed condition having a first permeability to fluid to a second, deformed condition having a greater permeability to fluid so that a greater amount of fluid F can pass therethrough.

Figure 8B:
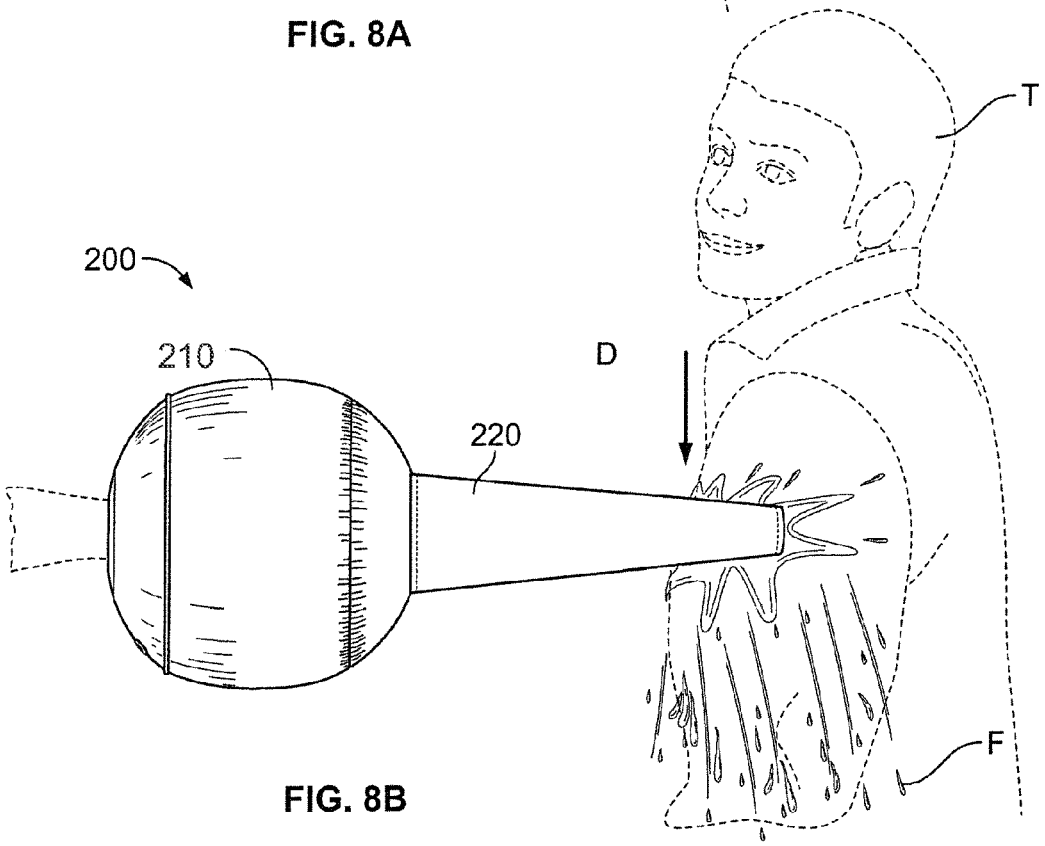
FIG. 8B is a second sequential view of a method of using the toy glove of FIG. 6.

Turning to FIG. 8B, a user may move the toy glove 200 so that the engagement portion 220 contacts a target T along a direction of impact D. In embodiments, toy glove 200 may be, for example, thrust, swung, or slapped against target T. The impact force of engagement portion 220 with target T causes the absorbent layer 224 to mechanically deform to cause fluid F to be displaced therefrom under pressure and through retention layer 226. Further, movement of the toy glove 200 may impart movement to portions of fluid F retained in the absorbent layer 224 so that portions of fluid F are caused to be moved therefrom and impact retention layer 226 to pass therethrough. The fluid F travels substantially along the direction of impact D so that a visual, tactile, and/or auditory amplification of impact is provided in the manner described above with respect to toy glove 100.

Figure 9:
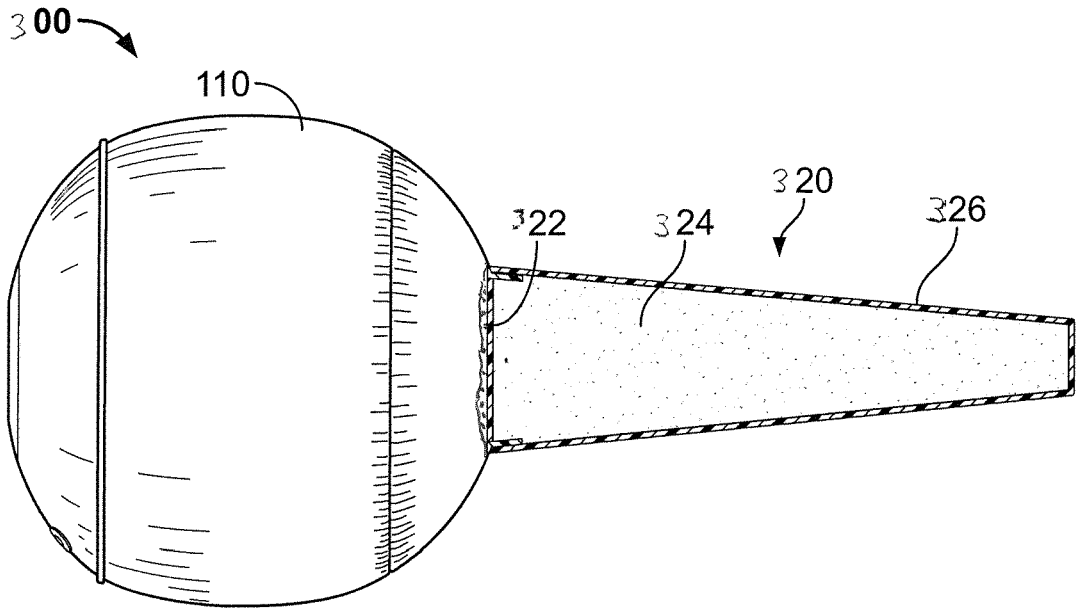
FIG. 9 is a cross-sectional view of a toy glove according to an exemplary embodiment of the present disclosure.

Turning to FIG. 9, an exemplary embodiment of a toy glove is generally designated 300. Toy glove 300 may include similar features to toy gloves 100, 200 discussed above such as a user engagement portion 110 and a fluid retention portion 320 with an elongate, conical profile. Toy glove 300 may include an attachment layer 322, an absorbent layer 324, and a retention layer 326 that may be formed of substantially similar materials to attachment layer 122, absorbent layer 124, and retention layer 126 described above. Absorbent layer 324 may have an elongate, conical profile so that the fluid retention portion 320 defines an elongate, conical profile without a longitudinal extent as in toy glove 200 described above. Attachment layer 322 and retention layer 326 may be disposed about fluid retention portion 320 in any suitable manner as described above with respect to toy glove 200. In embodiments, absorbent layer 324 may have any desirable shape or profile to suit particular needs of use.

While this invention has been described in conjunction with the embodiments outlined above, it is evident that many alternatives, modifications and variations will be apparent to those skilled in the art. For example, the toy gloves disclosed herein may include any number of surface designs or patterns for aesthetic effect. Accordingly, the exemplary embodiments of the invention, as set forth above, are intended to be illustrative, not limiting. Various changes may be made without departing from the spirit and scope of the invention.

The invention claimed is:

1. A toy glove, comprising:

an inflatable user engagement portion;

a fluid retention portion affixed to the user engagement portion and comprising:

an attachment layer;

an absorbent layer configured to absorb and retain fluid, the absorbent layer compressible under an applied force so that fluid stored in the absorbent layer is displaced therefrom under pressure; and a retention layer covering the absorbent layer and exposed on a front face of the toy glove, the retention layer being semi-permeable so that the retention layer inhibits fluid at an equilibrium state from flowing therethrough and allows at least a portion of the fluid displaced from the absorbent layer under pressure to pass therethrough.

2. The toy glove of claim 1, wherein the absorbent layer is encased between the attachment layer and the retention layer.

3. The toy glove of claim 1, wherein the retention layer is formed of lycra.

4. The toy glove of claim 1, wherein the attachment layer is configured to be heat sealed to a front end of the user engagement portion.

5. The toy glove of claim 1, wherein the retention layer is stitched to the attachment layer.

6. The toy glove of claim 1, wherein, upon impact with the target, the absorbent layer is configured to displace the fluid under pressure in the direction of impact with the target in the form of a splash, stream, wave, or droplets of the fluid.

7. The toy glove of claim 1, wherein the retention layer is reconfigurable between a first, unstressed condition, and a second, deformed condition.

8. The toy glove of claim 7, wherein the retention layer defines a first permeability to fluid in the first condition, and the retention layer defines a second, higher permeability to fluid in the second condition.

9. The toy glove of claim 7, wherein the retention layer has a resilient configuration that tends to return toward the first condition.

10. A toy glove, comprising:

an inflatable user engagement portion including a cavity for receiving a portion of a user's body and a forward extent extending from a front face thereof; and a fluid retention portion attached to the user engagement portion and having an elongate, conical profile, the fluid retention portion comprising:

an attachment layer sealably attached to the user engagement portion;

an absorbent layer configured to absorb and retain fluid, the absorbent layer compressible under an applied force to displace fluid retained therein; and a retention layer exposed on a front face of the toy glove about the absorbent layer and attached to the attachment layer so that the absorbent layer is encased therebetween, the retention layer being semi-permeable so that the retention layer inhibits fluid at an equilibrium state from flowing therethrough and allows at least a portion of the fluid displaced from the absorbent layer under pressure to pass therethrough.

11. The toy glove of claim 10, wherein the retention layer is formed of lycra.

12. The toy glove of claim 10, wherein the visual amplification of impact has the form of a splash, stream, wave, or droplets of the fluid.

13. The toy glove of claim 10, wherein the visual amplification of impact occurs along a direction of impact with the target.

14. The toy glove of claim 10, wherein one or more of the attachment layer, absorbent layer, and retention layer has a different length.

15. The toy glove of claim 10, wherein the forward extent has a conical configuration.

16. The toy glove of claim 10, wherein the retention layer is reconfigurable between a first, unstressed condition, and a second, deformed condition.

17. The toy glove of claim 16, wherein the retention layer defines a first permeability to fluid in the first condition, and the retention layer defines a second, higher permeability to fluid in the second condition.

18. The toy glove of claim 16, wherein the retention layer has a resilient configuration that tends to return toward the first condition.

19. A method of using a toy glove, comprising:

providing the toy glove comprising:

a user engagement portion; and a fluid retention portion affixed to the user engagement portion and comprising:

an attachment layer;

an absorbent layer configured to absorb and retain fluid, the absorbent layer compressible under an applied force; and a retention layer covering the absorbent layer and exposed on a front face of the toy glove, the retention layer being semi-permeable;

exposing the user engagement portion to a fluid;

exerting a force on the user engagement portion so that the absorbent layer is compressed to cause a pressure differential to draw fluid through the retention layer; and impacting the user engagement portion against a target so that an impact force is exerted on the absorbent layer to cause displacement of fluid through the retention layer in the direction of impact.

20. The method of claim 19, wherein the step of impacting the user engagement portion against a target includes reconfiguring the retention layer from a first, unstressed condition to a second, deformed condition having a higher permeability to fluid than the first condition.

* * * * *